United States Patent [19]

Koslowski

[11] 4,202,511

[45] May 13, 1980

[54] THREAD BRAKING DEVICE

[75] Inventor: Gerhard Koslowski, Mönchen-Gladbach, Fed. Rep. of Germany

[73] Assignee: W. Schlafhorst & Co., Mönchen-Gladbach, Fed. Rep. of Germany

[21] Appl. No.: 973,030

[22] Filed: Dec. 26, 1978

[30] Foreign Application Priority Data

Dec. 27, 1977 [DE] Fed. Rep. of Germany ..... 2758334
Jul. 10, 1978 [DE] Fed. Rep. of Germany ..... 2830205

[51] Int. Cl.[2] ..... B65A 59/24
[52] U.S. Cl. ..... 242/150 R; 242/131
[58] Field of Search ..... 242/150 R, 150 M, 149, 242/147 R, 131, 131.1

[56] References Cited

U.S. PATENT DOCUMENTS

| | | | |
|---|---|---|---|
| 1,007,787 | 11/1911 | McKean | 242/150 R UX |
| 2,029,943 | 2/1936 | Reiners et al. | 242/150 R |
| 2,034,356 | 3/1936 | Reiners et al. | 242/150 R X |
| 2,438,180 | 3/1948 | McDermott | 242/150 R |
| 3,297,264 | 1/1967 | Gilbos | 242/150 R X |
| 3,459,389 | 8/1969 | Wildi et al. | 242/150 R |
| 3,967,657 | 7/1976 | Cugini | 242/150 R X |

*Primary Examiner*—Stanley N. Gilreath
*Attorney, Agent, or Firm*—Herbert L. Lerner

[57] ABSTRACT

Thread braking device including a rotatably driven lower dish and upper dish, a device for applying a load to the upper dish, a guidance housing surrounding and guiding the upper dish, and rotary drive means for rotating the guidance housing.

3 Claims, 2 Drawing Figures

THREAD BRAKING DEVICE

Figure 1:
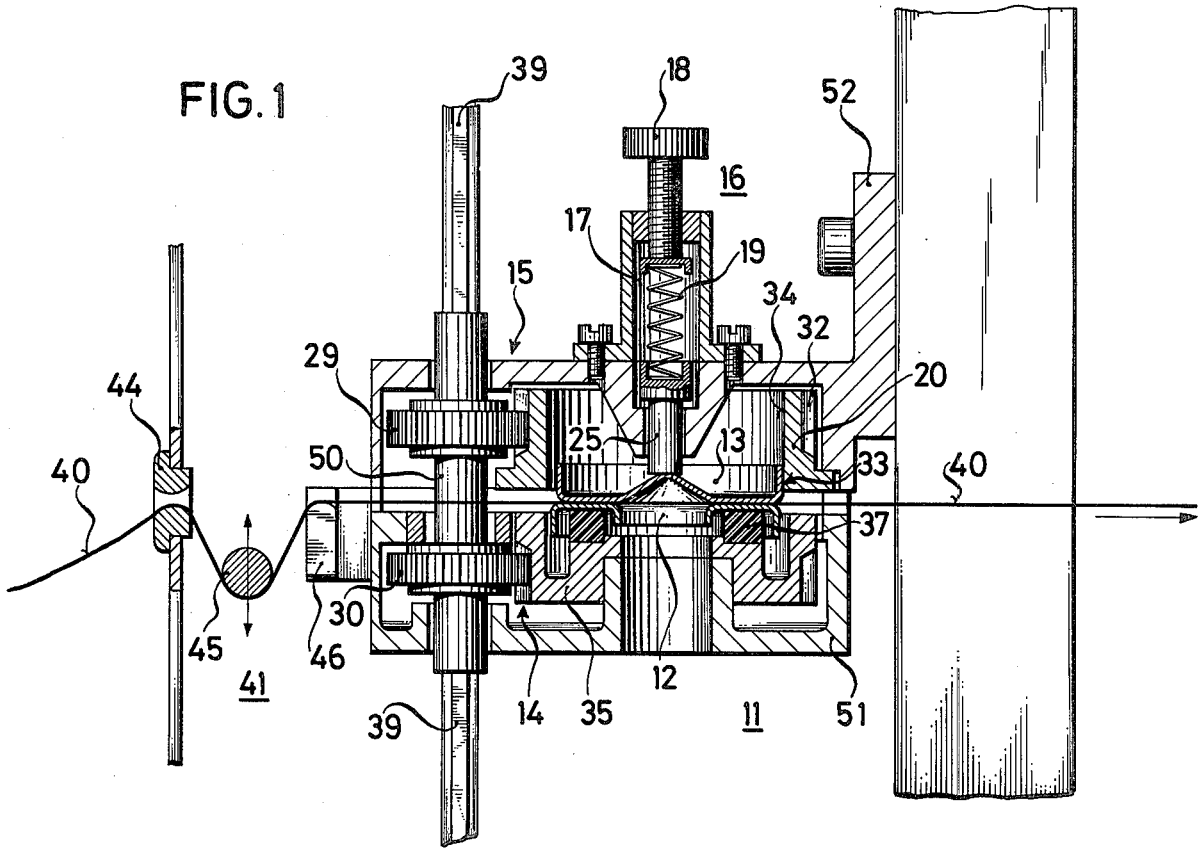

The invention relates to a thread braking device formed of a rotatably driven lower dish and upper dish, a device for applying a load to the upper dish, and a guide housing for the upper dish.

It has been a problem to keep the braking action constant in such thread braking devices.

It is accordingly an object of the invention to provide a thread braking device wherein the braking action of the individual thread brakes is kept constant even under unfavorable conditions.

With the foregoing and other objects in view, there is provided, in accordance with the invention, a thread braking device comprising a rotatably driven lower dish and upper dish, a device for applying a load to the upper dish, a guidance housing surrounding and guiding the upper dish, and rotary drive means for rotating the guidance housing.

When the guidance housing is stationary, the rim of the upper dish, which is set into rotation by the traveling thread, continuously rubs against or frictionally engages the inner surface of the guidance housing. In addition, the friction effect is nonuniform. The rotary drive according to the invention reduces the friction between the upper dish and the guidance housing depending upon how the rotation of the guidance housing is matched to the rotation of the upper dish.

In accordance with another feature of the invention, the lower dish is rotatably driven by rotary drive means, the rotary drive means for rotating the guidance housing being connected to the rotary drive means for the lower dish. Since the lower dish is driven anyway, connecting the two rotary drives reduces the manufacturing costs.

To permit trouble-free operation of many similar thread brakes in a creel assembly, wherein the thread brakes are disposed in horizontal and vertical rows, there is provided, in accordance with a concomitant feature of the invention, a shaft for driving the rotary drive means, the shaft carrying a drive gear for driving the shaft, and a serrated belt or chain meshing with the drive gear. It is not necessary that each lower dish and each upper dish have a separate shaft. A shaft may be provided not only for an individual thread brake but also in common for several thread brakes disposed on top of one another. In the creel assembly, each such vertical shaft has a driving gear, and the serrated endless belt or the endless chain is conducted over all of the driving gears.

Accordingly, the advantages attained by the invention are, furthermore, that, in an arrangement of the thread brakes in a creel assembly, there is complete freedom regarding the choice of spacings between the shafts for the same drive elements, that alignment errors in the creel assembly structure have no adverse effects upon the rotary drives of the thread brakes; that individual thread brake units can be disassembled by simple uncoupling of the shaft from the serrated belt or the chain without disturbing the further operation of the creel; and that, with the device according to the invention, there is no danger of synchronization or gauging difficulties which occur with individual drives or with drives over long, horizontally guided shafts.

Other features which are characteristic for the invention are set forth in the appended claims.

Although the invention is illustrated and described herein as embodied in thread braking device, it is nevertheless not intended to be limited to the details shown, since various modifications and structural changes may be made therein without departing from the spirit of the invention and within the scope and range of equivalents of the claims.

Figure 2:
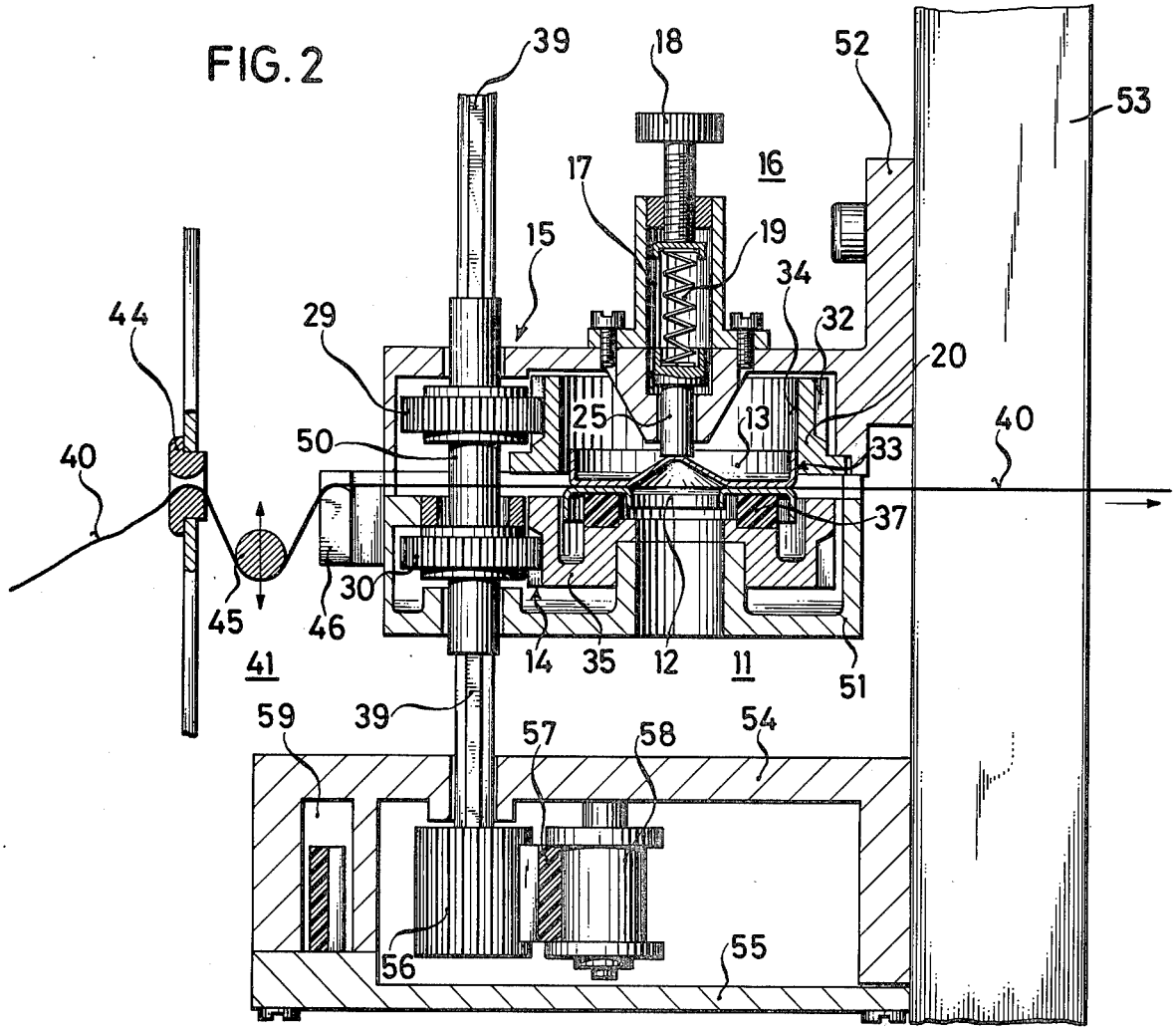

The construction and method of operation of the invention, however, together with additional objects and advantages thereof will be best understood from the following description of specific embodiments when read in connection with the accompanying drawings, in which:

FIG. 1 is a cross-sectional view of one embodiment of the thread braking device according to the invention; and FIG. 2 is a view similar to that of FIG. 1 of another embodiment of the invention.

Referring now to the drawing and first, particularly, to FIG. 1 thereof, there is shown a thread braking device identified as a whole by reference numeral 11, and formed of a dish combination including a lower dish 12, an upper dish 13 and a rotary drive 14. A rotary drive 15 drives a guidance housing 20 of the upper dish 13. A loading or load-applying device 16 with adjustable pressure acts upon the upper dish 13.

The loading device 16 includes a chamber 17, wherein a compression spring 19, adjustable by means of a screw 18, is disposed.

A plunger 25 extending through a wall of the chamber 17 serves for transmitting the pressure from the compression spring 19 to the upper dish 13.

The rotary drive 15 has a gear 29 which meshes with external gearing 32 provided on the guidance housing 20. An outer rim 33 of the upper dish 13 makes frictional contact with an inner surface 34 of the guidance housing 20.

The rotary drive 14 has a gear 30 and a gear 35, the latter provided with a friction lining 37 disposed on an end face thereof, the lower dish 12 being supported on the friction lining 37. A shaft 39 serves as a common drive for the rotary drive 14 and 15.

A thread looping device 41 is inserted into the travel path of the thread 40. The thread-looping device 41 is adjustable. It is formed of a thread grommet or eye 44, an adjustable looping member 45 and a stationary looping member 46.

The thread 40 extends initially in the travel direction through the thread-looping device 41, tangentially engages a bearing 50 of the shaft 39, passes off-center between the lower dish 12 and the upper dish 13 of the thread brake 11 and, if desired, continues on with a lateral deflection.

A rugged frame of cast metal, formed of a lower part 51 and an upper part 52, serves as the support of the hereinaforementioned parts and ensures vibration-free travel of the thread.

FIG. 1 of the drawing illustrates normal operation of the embodiment of the thread braking device. The plunger 25 applies a loading centrally to the upper dish 13. The rim 33 of the upper dish 13 has made contact with the inner surface 34 of the guidance housing 20 in travel direction of the thread 40 under the action of the thread tension. Rolling friction thus occurs at the contact point.

Because the braking action of the novel thread brake according to the invention is very constant over extended periods of time, the novel thread brake is especially well suited for filamentary yarn in creel operation.

The term "upper dish" and "lower dish", respectively, is also supposed to include plate-shaped or disc-shaped structures. The loading of the upper dish can alternatively also be effected pneumatically or in any other suitable manner.

In FIG. 2 of the drawing, the same thread brake 11 is illustrated which is also shown in FIG. 1, but with the following variations:

The upper part 52 is fastened to a vertical support 53. At a lower part thereof, the support 53 carries a housing 54 which is closed by a cover 55. The shaft 39 extends through a wall of the housing 54 and carries at an end thereof a driving gear 56. An endless serrated belt 57 is guided so that it meshes with the driving gear 56. Guidance is provided by a guide roller 58. The return run of the serrated belt 57 is guided in a separate chamber 59 of the housing 54.

The shaft 39 as well as the support 53 are shown partly broken away at the top thereof in FIG. 2. Both the shaft 39 and the support 53 can extend over several levels of a creel, such as over 6 levels, for example. The shaft 39 can also be formed of individual sections which are connected together by means of suitable coupling elements. The serrated belt 57 can be provided with protective covers over the entire length thereof. At an end thereof, the serrated belt 57 has a suitable non-illustrated, conventional serrated-belt drive.

FIG. 2 of the drawing likewise illustrates normal operation of the illustrated embodiment. The plunger 25 applies a loading centrally to the upper dish 13. The rim 33 of the upper dish 13 has made contact with the inner surface 34 of the guidance housing 20 in travel direction of the thread 40 under the action of thread tension. Rolling friction occurs at the point of contact, because the guidance housing also rotates in the same direction.

There are claimed:

1. Thread breaking device comprising a rotatably driven lower dish and upper dish having confronting surfaces for frictionally engaging a thread passing therebetween, a device for applying a load to the upper dish so as to urge said confronting surfaces toward each other and vary tension applied to the thread, rotary drive means for rotating said lower dish, a guidance housing surrounding and driving said upper dish, and rotary drive means for rotating said guidance housing.

2. Thread braking device according to claim 1 wherein said rotary drive means for rotating said guidance housing is connected to said rotary drive means for said lower dish.

3. Thread braking device according to claim 1 or 2 including a shaft for driving said rotary drive means, said shaft carrying a drive gear for driving said shaft, and a serrated belt or chain meshing with said drive gear.

* * * * *